United States Patent [19]

Eddins et al.

[11] Patent Number: 4,670,820

[45] Date of Patent: Jun. 2, 1987

[54] ANIMATED NIGHT-LIGHT AND MUSIC-BOX COMBINATION

[75] Inventors: Fred D. Eddins, Mapleville; William B. Cooke, Warwick, both of R.I.

[73] Assignee: Hasbro, Inc., Pawtucket, R.I.

[21] Appl. No.: 799,354

[22] Filed: Nov. 15, 1985

[51] Int. Cl.[4] ..... H04M 1/22

[52] U.S. Cl. ..... 362/86; 362/190; 446/227; 40/455; 40/408; 84/94 R

[58] Field of Search ..... 446/297, 298, 227, 485, 446/408; 84/94 R; D17/24; 40/455; 362/190, 295, 86

[56] References Cited

U.S. PATENT DOCUMENTS

| | | | |
|---|---|---|---|
| 2,554,941 | 5/1951 | Dabrowsky | 40/455 |
| 3,114,216 | 12/1963 | Crawford et al. | 40/455 |
| 3,244,052 | 4/1966 | Stubbmann | 446/297 |
| 3,525,862 | 8/1970 | Carter et al. | 362/86 |
| 3,927,482 | 12/1975 | Marcus | 40/455 |
| 4,298,915 | 11/1981 | Goldfarb et al. | 362/196 |
| 4,373,918 | 2/1983 | Berman | 446/408 |
| 4,521,205 | 6/1985 | Spector | 446/408 |

*Primary Examiner*—E. Rollins Cross

*Attorney, Agent, or Firm*—Salter & Michaelson

[57] ABSTRACT

An animated night-light and music-box combination comprises a housing, a pull-cord-type drive assembly mounted in the housing, a rotatable display disc having visual display thereon driven by the drive assembly and mounted in the housing, a music-box assembly driven by the drive assembly and mounted in the housing and a lighting assembly mounted in the housing. The combination device is operable by pulling a pull cord of the drive assembly to withdraw the pull cord from the housing and then releasing the pull cord to actuate the drive assembly. Upon actuation of the drive assembly, the display disc is rotated to animate the display thereon and the music-box assembly is actuated to produce music which accompanies the animated display. The lighting assembly is actuated to illuminate the animated display whenever the pull cord is withdrawn from the housing, and it is manually actuatable when the pull cord is recoiled in the housing on the drive assembly.

5 Claims, 6 Drawing Figures

ANIMATED NIGHT-LIGHT AND MUSIC-BOX COMBINATION

BACKGROUND AND SUMMARY OF THE INVENTION

The instant invention relates to children's toys and more particularly to an animated night-light and music-box combination toy which is operable for providing amusement for small children and for assisting them in going to sleep.

Various types of animated sound producing devices have been heretofore available for providing amusement for small children and for assisting them in going to sleep. In this connection, a number of music-box-type devices have been heretofore available for accomplishing these purposes, although they have not always been entirely effective. In addition, various types of animated toys have been heretofore available for providing amusement for small children and for assisting them in going to sleep, and they also have not always been entirely effective.

The instant invention provides a novel animated night-light and music-box combination which can be effectively utilized for providing amusement for small children and for assisting them in going to sleep, as well as for providing a night light which can be utilized for assisting parents or baby-sitters in checking on the well being of children after they have fallen asleep. Specifically, the animated night-light and music-box combination of the instant invention comprises a housing, a pull-cord drive assembly mounted in the housing, an animated display assembly mounted in the housing so that it is visible from the exterior thereof, a music-box assembly mounted in the housing, and a lighting assembly mounted in the housing. The animated display assembly is driven by the drive assembly for effecting animation thereof, and the music-box assembly is driven by the drive assembly for producing audible sound; whereas the lighting assembly is connected to the drive assembly for illuminating the animated display and for producing light which is visible on the exterior of the housing in response to operation of the drive assembly. The animated display assembly preferably comprises a rotatable translucent disc having a plurality of ficticious characters displayed on the face thereof; and upon actuation of the drive assembly, the rotatable disc is rotated to animate the characters thereon. The night-light and music-box combination preferably further comprises a manual actuating assembly for the lighting assembly which is operable by manually depressing a button on the exterior of the housing for actuating the lighting assembly. The drive assembly preferable comprises a pull cord and a handle attached to the pull cord on the exterior of the housing, and the drive assembly is preferably operative by withdrawing the pull cord from the housing with the handle and releasing the handle so that the pull cord is retracted into the housing until the drive assembly is returned to a recoiled position, wherein the handle element engages the housing. Accordingly, when the pull cord is released after is has been withdrawn from the housing, the drive assembly is actuated to effect the operation of the music-box assembly and the animated display assembly; whereas the lighting assembly is actuated as soon as the pull cord is withdrawn from the housing. However, when the pull cord is returned to its fully-recoiled position, the drive assembly is deactuated so that the music-box assembly and the display assembly are actuated, and the lighting assembly is also deactuated. Hence, when the night-light and music-box combination of the instant invention is utilized for assisting a small child in going to sleep, it is actuated by withdrawing and then releasing the pull cord so that the music-box assembly, the display assembly and the lighting assembly are operated for a period of time until the pull cord is fully retracted. This provides amusement for the child while at the same time providing a condition which is conducive to sleep for the child. Thereafter, when the pull cord is retracted to its recoiled position, the music-box assembly, the display assembly, and the lighting assembly are deactuated so that the child can sleep in silence and in darkness. However, since the lighting assembly is also operably by manually depressing a button on the exterior of the housing, a parent or a baby-sitter can check on the childs well being at any time by manually actuating the lighting assembly so that the child can be observed.

Devices representing the closest prior art to the instant invention of which the applicant is aware are disclosed in the U.S. patents to MISELL U.S. Pat. No. 551,394; CARTER ET AL U.S. Pat. No. 3,525,862; MAYER U.S. Pat. No. 3,561,861; STUBBMANN U.S. Pat. No. 3,998,234; GOLDFARB ET AL U.S. Pat. No. 4,298,915; and KITAMURA U.S. Pat. No. 4,450,939. However, since these references fail to disclose or suggest an animated night-light and music-box combination, and particularly one embodying the structural features of the instant invention, they are believed to be of only general interest.

Accordingly, it is a primary object of the instant invention to provide an amusement device for a small child which is also operative for assisting the child in going to sleep.

Another object of the instant invention is to provide an effective animated night-light and music-box combination.

A still further object of the instant invention is to provide an effective animated night-light and music-box combination which is actuated by withdrawing a pull cord from a housing and deactuated when the pull cord is retracted into the housing.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
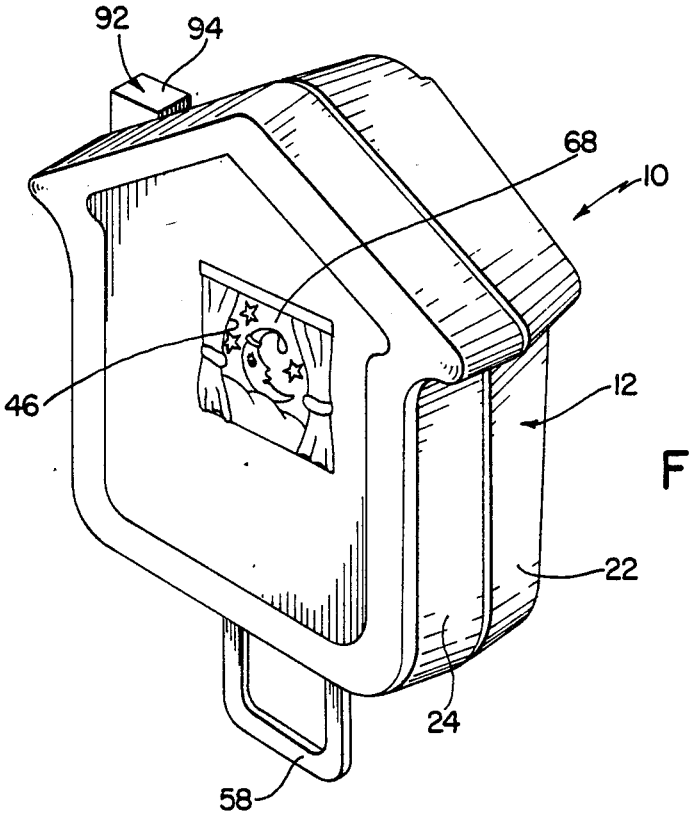
FIG. 1 is a perspective view of the animated night-light and music-box combination of the instant invention.
Figure 2:
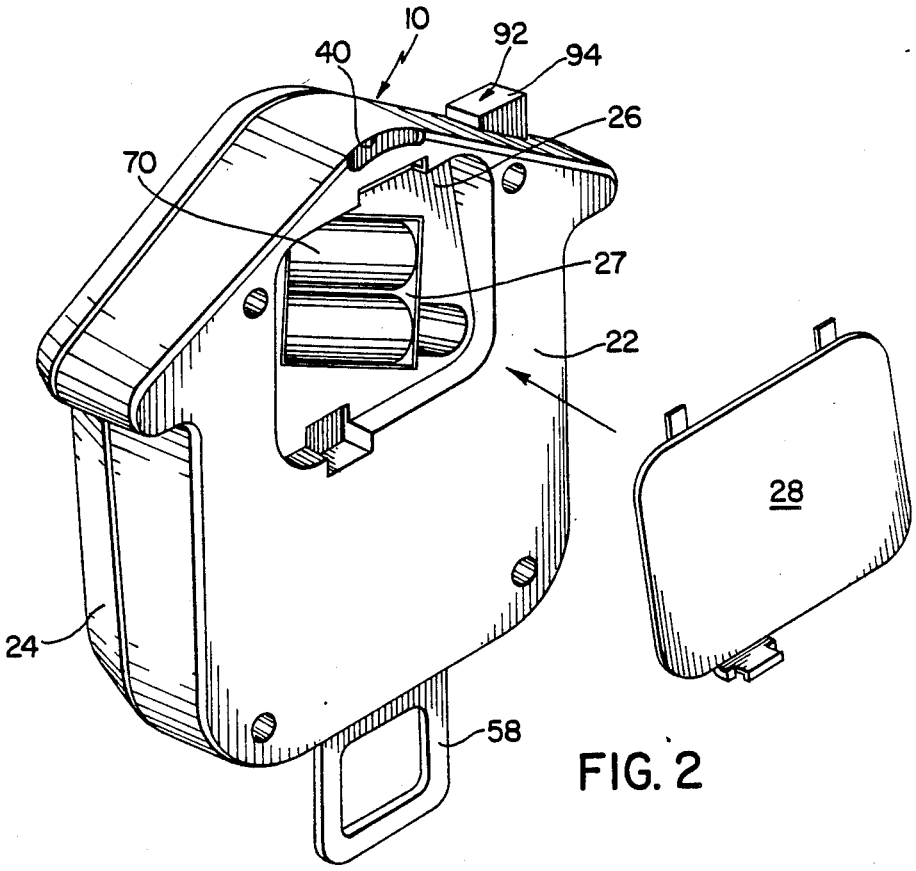
FIG. 2 is a rear perspective view thereof with the battery cover removed.
Figure 3:
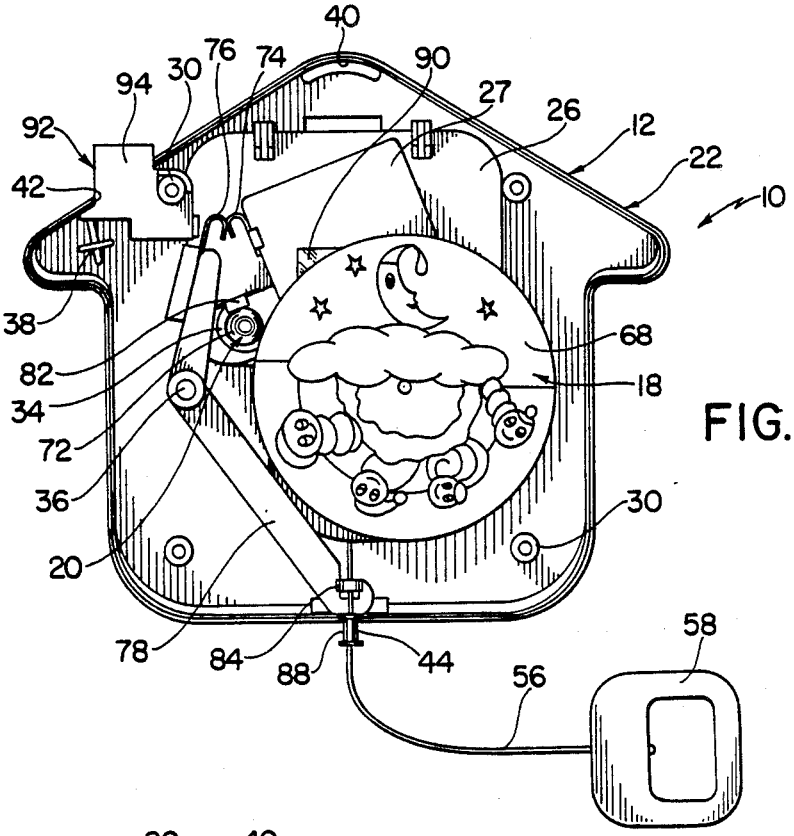
FIG. 3 is a plan view thereof in an actuated condition with the front portion of the housing removed.

Referring now to the drawings, the animated night-light and music-box combination of the instant invention is illustrated and generally indicated at 10 in FIGS. 1 through 4. The combination 10 comprises a housing generally indicated at 12, a drive assembly generally indicated at 14, an animated display assembly generally indicated at 18, and a lighting assembly generally indicated at 20. Upon actuation of the drive assembly 14, the music-box assembly 16 produces audible music, the display assembly 18 rotates to provide an animated display which is visible from the exterior of the housing 12, and the lighting assembly 20 illuminates the display assembly 18 and produces light which is visible from the exterior of the housing 12.

The housing 12 is preferably molded from a suitable plastic material in a configuration which resembles the silhouette of a house, and it comprises a rear section 22 and a front section 24 which cooperate for defining an open interior area in the housing 12 wherein the drive assembly 14, the music-box assembly 16, the display assembly 18, and the lighting assembly 20 are mounted. The rear housing section 22 is formed with a rearwardly opening recess 26 therein, and a battery compartment 27 is formed in the recess 26. A cover 28 is detachably received in the recess 26 for providing a cover therefor and for the battery compartment 27. A plurality of apertured mounting posts 30 are provided in each of the rear and front housing sections 22 and 24, respectively; and mounting screws (not shown) are received in the apertures in the post 30 for securing the rear and front housing section 22 and 24, respectively, in assembled relation. Also formed in the rear housing section 22 is a drive assembly partition 32 in which the drive assembly 14 is mounted, and a lamp base 34 is integrally formed with the rear housing section 22 for mounting a portion of the lighting assembly 20 in a manner which will hereinafter be more fully set forth. A pivot post 36 and a stop element 38 are also integrally formed in the rear housing section 22. An aperture 40 is formed in the rearwardly facing wall of the rear housing section 22, an opening 42 is provided in the upper wall of the housing section 22, a reduced notch 44 is provided in the bottom wall thereof, and a similar notch (not shown) is provided in a corresponding location in the front housing section 24. An aperture 46 which is configured to simulate a window opening is provided in the front wall of the front housing section 24.

The drive assembly 14 comprises a base 48, a gear housing 50 from which a drive shaft 52 extends, a plurality of drive gears 54, a recoil assembly (not shown) to which a pull cord 56 is attached, and a handle element 58 on the pull cord 56. The base 48 is mounted on the partition 32 in the rear housing section 22 so that the pull cord recoil assembly (not shown) is contained within the partition 32. The gear housing 50 projects forwardly from the base 48, and the shaft 52 projects from the gear housing 50. The drive gears 54 are mounted on the base 48 for driving the music-box assembly 16, as will hereinafter be more fully set forth, and the pull cord 56 is connected to the recoil assembly (not shown), and it extends through the notch 44 so that the handle 58 is disposed on the exterior of the housing 12. The drive assembly 14 is operative by pulling the handle element 58 so that the string 56 is withdrawn from the recoil assembly to effect winding of the drive assembly. Thereafter, when the handle element 58 is released, the cord 56 is recoiled on the recoil assembly (not shown), and the drive gears 54 and the drive shaft 52 are rotated.

The music-box assembly 16 comprises a rotatable drum 60 having a plurality of pins 62 on the circumferential surface thereof and a reed assembly 64 having a plurality of musical reeds 66 thereon. The drum 60 and the reed assembly 64 are mounted on the base 48 of the drive assembly 14 so that the drive gears 54 of the drive assembly 14 operate to rotate the drum 60. The reed assembly 64 is mounted so that the terminal ends of the reeds 66 thereof are adjacent the circumferential periphery of the drum 60 and so that the reeds 66 engage the pins 62 when the drum 60 is rotated to produce, musical notes from the music-box assembly 16.

The display assembly 18 comprises a substantially flat, circular transulcent disc 68 having a visual display comprising a plurality of fictitious characters on the front surface thereof and a shaft (not shown) which extends rearwardly from the disc 68. The shaft (not shown) of the display assembly 18 is received on the drive shaft 52 of the drive assembly 14 for rotation therewith so that when the drive assembly 14 is actuated, the disc 68 rotates.

Figure 4:
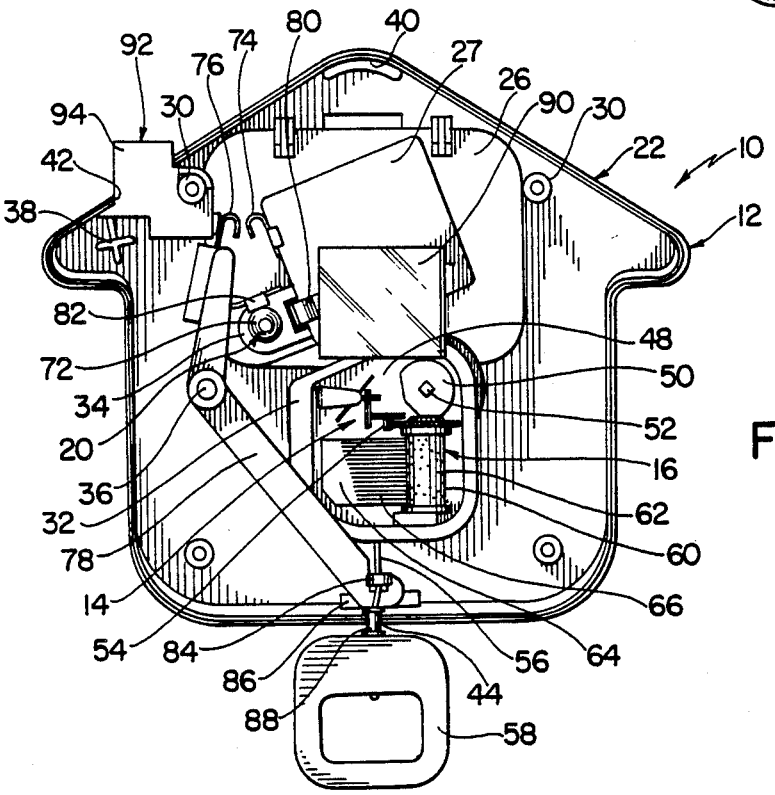
FIG. 4 is a similar view of the night-light and music-box combination in a deactuated condition and with the display disc removed.

The lighting assembly 20 comprises a pair of batteries 70 (see FIG. 2) which are mounted in the battery compartment 27, a light bulb 72 which is received in a light socket in the lamp base 34, a stationary contact 74, a movable contact 76, and an actuator arm 78. A conductor element 80 extends between the batteries 70 and the light bulb 72, and the stationary contact 74 is connected to the opposite pole of the batteries 70. The movable contact 76 includes a tab 82 which is electrically connected to the light 72, and it is made of a resilient metal and biased to a position wherein it is in engagement with the fixed contact 74 to complete an electrical circuit between the batteries 70 and the light bulb 72. The movable contact 76 is, however, resiliently deflectable to a position wherein it is spaced from the fixed contact 74, as illustrated in FIG. 4, so that the circuit between the light bulb 72 and the batteries 70 is interrupted. The actuator arm 78 is pivotally mounted on the post 36, and it extends from a point adjacent the aperture 44 to a point adjacent the movable contact 76. A pin (not shown) extends rearwardly from the actuator arm 78, and it is engageable with the inner side of the movable contact 76 for separating it from the fixed contact 74 as the actuator arm 78 is pivoted outwardly. The actuator arm 78 further comprises an apertured tab 84 through which the cord 56 exends, and a cross bar 86 is formed on the arm 78 so that it is normally positioned adjacent the notch 44 in the rear housing section 22. The lighting assembly 20 further comprises an eyelet 88 having enlarged flanges at opposite ends thereof which is slidably received on the string 56 and positioned thereon so that it is slidably contained in the notch 44. The eyelet 88 is positioned so that as the handle 58 is drawn inwardly to a position adjacent the housing 12, it engages the eyelet 88 to move it inwardly in the notch 44 so that is moves the cross bar 86 inwardly to pivot the actuator arm 78. This causes the movable contact 76 to be separated from the fixed contact 74 by the pin (not shown) on the arm 78 so that the circuit comprising the light bulb 72 and the batteries 70 is interrupted. However, when the handle 58 is drawn outwardly to pull the string 56 from the recoil assembly (not shown) of the drive assembly 14, the handle 58 is disengaged from the eyelet 88 so that the pivot arm 78 is pivoted by the resiliency of the movable contact 76 and the movable contact 76 engages the fixed contact 74 to complete the circuit between the light bulb 72 and the batteries 70. Accordingly, when the handle element 58 is moved away from the housing 12, the light bulb 72 is energized to effect the illumination thereof. Still further included in the lighting assembly 20 is a mirror 90 which is mounted on the rear housing section 22 in an angular disposition so that it is operative for reflecting light from the light bulb 72 onto the rear side of that portion of the disc 68 which is disposed adjacent the aperture 46 in the front housing section 24. Hence, since the disc 68 is translucent, that portion of the disc 68 which is positioned adjacent the aperture 46 at any given instant is illuminated by the light bulb 72 whenever the lighting assembly 20 is actuated.

Figure 5:
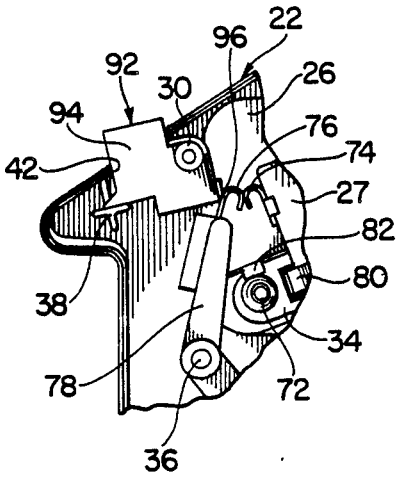
FIGS. 5 and 6 are similar fragmentary views of the mechanism for manually actuating the lighting assembly of the combination.
Figure 6:
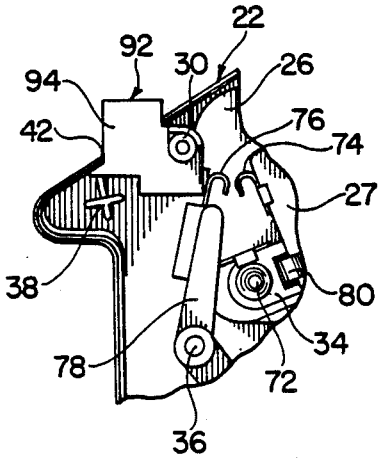

The lighting assembly 20 further comprises a manual switching assembly which is generally indicated at 92. The manual switching assembly 92 comprises a push-button element 94 which is pivotally mounted on a post 30 which is located adjacent the opening 42, and the stop element 38 which is integrally molded in the rear housing section 22 adjacent the opening 42. The push-button element 94 is mounted in the opening 42, and it is biased by a spring (not shown) to a position wherein it projects outwardly through the opening 42, but it is manually depressible to cause it to pivot on the post 30 on which it is mounted. In this connection, the inner portion of the push-button element 94 is formed so that when the push-button element 94 is manually depressed, the inner portion thereof pivots inwardly and engages the movable contact 76. Accordingly, as illustrated in FIGS. 4 and 5, when the movable contact 76 is separated from the fixed contact 74 and the push-button element 94 is manually depressed, the inner portion thereof engages the movable contact 76 as at 96 to urge it inwardly into engagement with the fixed contact element 74. In this regard, although the post (not shown) on the arm 78 engages the inner side of the movable contact 76 to hold it outwardly so that it is normally spaced from the contact 74 whenever the handle 58 is in its retracted position, the resiliently flexible construction of the movable contact 76 permits it to be nevertheless moved into engagement with the contact 74 by the push-button element 94. The stop element 38 is positioned so that when it is pivoted to a position wherein it moves the movable contact element 76 into engagement with the fixed contact element 74, the push-button element 94 engages the stop element 38 to prevent it from being pivoted further.

For use and operation of the animated night-light and music-box combination 10, the handle element 58 is pulled from the housing 12 to pull the string 56 from the recoil assembly (not shown) of the drive assembly 14. When the handle 58 is pulled from the housing, the eyelet 88 no longer applies pressure to the cross bar 86 so that the arm 78 pivots on the post 36, and the movable contact 76 is moved into engagement with the fixed contact 74 to complete the circuit between the light 72 and the batteries 70. When the handle 58 is then released to allow the string 56 to be recoiled on the recoil mechanism (not shown) of the drive assembly 14, the shaft 52 and the gears 54 are rotated. Accordingly, the disc 68 is rotated by the shaft 52 to produce an animated display in the aperture 46 which is illuminated by the lighting assembly 20, and the drum 60 is rotated by the gears 54 to produce music from the music-box assembly 16 which accompanies the animated display in the aperture 46. When the string 56 is finally recoiled to a point where the handle element 58 engages the eyelet 88, the tension of the cord 56 causes the handle element 58 to move the eyelet 88 inwardly in the housing 12 so that it pivots the arm 78. As a result, the arm 78 moves the movable contact element 76 away from the fixed contact element 74 to interrupt the circuit comprising the battery 70 and the light bulb 72. However, after the movable contact 76 has been separated from the fixed contact 74, the push-button element 94 can be manually depressed to once again move the movable contact element 76 into engagement with the fixed contact element 74 and to thereby complete the circuit comprising the light bulb 72 and the battery 70 so that the light bulb 72 is illuminated and light is emitted from the device 10.

It is seen, therefore, that the instant invention provides an effective animated night-light and music-box combination. The handle element 58 can be withdrawn from the housing 12 to actuate the lighting assembly 20; and when the handle element 58 is released, the disc 68 rotates to provide an animated display in the aperture 46, and the music-box assembly 16 produces audible music. This provides a highly effective combination which can be used for inducing sleep in a small child. Further, after the child has gone to sleep, the push-button element 94 can be manually depressed to provide a night-light in order to check on the child's well-being. Hence, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An animated night-light and music-box combination comprising a housing, pull-cord drive means mounted in said housing and manually operable from the exterior thereof for actuating said drive means, animated display means mounted in said housing so that it is visible from the exterior thereof, said display means being driven by said drive means for effecting animation thereof, music-box means mounted in said housing and driven by said drive means for producing audible sound, lighting means mounted in said housing and responsive to said drive means for illuminating said display means and for producing light which is visible on the exterior of said housing whenever said drive means is actuated, said drive means comprising a pull string and a handle element on said pull string, said handle element being disposed on the exterior of said housing and being operable for withdrawing said pull string from said housing for winding and actuating said drive means, said drive means retracting said pull string into said housing during operation of said drive means, said handle element engaging said housing for deactuating said drive means and also for deactuating said light means when said pull string is fully retracted into said housing.

2. In the night-light and music-box combination of claim 1, said display means further characterized as comprising a rotatable disc display element, said drive means rotating said disc display element upon actuation of said drive means to effect said animated display.

3. The night-light and music-box combination of claim 1 further comprising means for manually actuating said lighting means.

4. An animated night-light and music-box combination comprising a housing, pull-cord drive means mounted in said housing and manually operable from the exterior thereof for actuating said drive means, animated display means mounted in said housing so that it is visible from the exterior thereof, said display means being driven by said drive means for effecting animation thereof, music-box means mounted in said housing and driven by said drive means for producing audible sound, lighting means mounted in said housing and responsive to said drive means for illuminating said display means and for producing light which is visible on the exterior of said housing whenever said drive means is actuated, said lighting means comprising a pair of contact elements, said contact elements being resiliently biased to a position of engagement to actuate said lighting means when said drive means is actuated but being separable to deactuate said lighting means, said drive means being movable to a recoiled position wherein it is deactuated, and means communicating with said drive means for separating said contact elements when said drive means is in said recoiled position, said drive means comprising a pull string and a handle element on said pull string, said handle element being disposed on the exterior of said housing and being operable for withdrawing said pull string from said drive means to effect the actuation thereof, said handle element engaging said housing when said drive means is in said recoiled position to effect the deactuation of said drive means, said handle element engaging said means communicating with said drive means to effect the separation of said contact elements when said drive means is in said recoiled position.

5. In the night-light and music-box combination of claim 4, said means communicating with said drive means comprising an arm pivotally mounted in said housing, said arm being pivotable to effect the separation of said contact elements but being biased to a position wherein said contact elements are in engagement, said handle element communicating with said arm to pivot it to effect the separation of said contact elements upon movement of said drive means to said recoiled position.

* * * * *